US005212963A

United States Patent [19]

McGinnis

[11] Patent Number: 5,212,963

[45] Date of Patent: May 25, 1993

[54] REFRIGERANT DEVICE FOR INSULATED BEVERAGE HOLDER

[76] Inventor: Barry N. McGinnis, Manufacturing Technology Corporation, 1850 Business Park Dr., Ste. 109, Clarksville, Tenn. 37040

[21] Appl. No.: 841,565

[22] Filed: Feb. 26, 1992

[51] Int. Cl.[5] ..... F25D 3/08

[52] U.S. Cl. ..... 62/457.4; 62/372; 62/530

[58] Field of Search ..... 62/457.1, 457.2, 457.3, 62/457.4, 457.6, 457.7, 457.8, 371, 372

[56] References Cited

U.S. PATENT DOCUMENTS

| | | | |
|---|---|---|---|
| 3,205,677 | 9/1965 | Stoner | 62/457.3 |
| 4,485,636 | 12/1984 | Hilado | 62/457.4 |
| 4,577,474 | 3/1986 | Peterson | 62/457.4 |
| 4,745,776 | 5/1988 | Clark | 62/457.4 |
| 4,383,422 | 5/1983 | Gordon et al. | 62/457.4 |
| 4,989,415 | 2/1991 | Lombness | 62/273 |

*Primary Examiner*—John M. Sollecito
*Attorney, Agent, or Firm*—Richard C. Litman

[57] ABSTRACT

A refrigerant puck for insertion an insulated beverage container holder. A portable beverage-filled container is inserted concentrically into the insulated holder such that a bottom surface of the beverage container contacts a top surface of the refrigerant puck which permits conductive heat transfer to occur, thus keeping the beverage container cool for an extended period while facilitating the consumption of a beverage therefrom. The refrigerant puck includes a disk-shaped container, preferably formed from a high-intensity polyurethane or polyethylene, which has a raised top surface that is substantially convex to mate with a concave bottom surface of the beverage container, thus ensuring a continuous and uniform contact with the majority of the bottom surface of the beverage-filled container which provides a direct cooling effect. The disk-shaped container further has a substantially concave bottom surface which mates with the convex top surface thereof which enables a plurality disk-shaped containers to stackably next one on top of another. The convex top surface and the concave bottom surface of the disk-shaped container each have a slight flat uppermost surface. This uppermost surface is provided to display indicia, such as an advertisement or a logo. This flat surface does not interfere with the ability of a plurality of refrigerant pucks to be stackably nested together. The disk-shaped container is filled with a non-toxic liquid refrigerant solution which imparts the aforementioned cooling effect on the beverage-filled container.

2 Claims, 1 Drawing Sheet

REFRIGERANT DEVICE FOR INSULATED BEVERAGE HOLDER

BACKGROUND OF THE INVENTION

1. Field of the Invention

The present invention relates to a device for keeping portable beverage-filled containers cool and more particularly, a disk-shaped refrigerant container which is insertable into an insulated beverage container holder such that the bottom surface of a beverage-filled container contacts the top surface of the disk-shaped container, thus keeping the beverage-filled container cool for an extended period.

2. Description of Prior Art

A variety of beverages ranging from fruit juices to soft drinks are made available in portable containers. These beverage containers are favored by participants of sporting and recreational activities. Frequently, the beverages are consumed over prolonged periods of time during which the beverage is exposed directly to the surrounding environment, eventually reaching ambient temperature and becoming unpalatable.

For this reason, insulated beverage container holders have gained widespread popularity. Insulated beverage container holders are known for retaining chilled or cooled beverage-filled containers and for their ability to retard the warming of the beverage therein. These holders are typically fabricated of relatively rigid styrofoam having generally either a snug fit configuration to the beverage-filled container or are provided with an upper lip or flange for grippingly receiving the beverage-filled container therein and insulating the same during consumption.

Some insulated beverage container holders employ refrigerant substances to keep beverage cooler for extended periods of time, more so that those holders incorporating merely insulating materials. Such refrigerant substances are usually confined to a subcompartment and are most commonly composed of freezable liquids such as the aqueous methyl cellulose, glycerines, and glycol-type compositions. The refrigerant substance is frozen in a freezer compartment and is subsequently used to keep the beverage cool for prolonged periods of time through conductive heat transfer, that is heat transfer from the beverage-filled container to the refrigerant.

U.S. Pat. No. 4,383,422 issued May 17, 1983 to Jay E. Gordon et al. discloses a portable insulated holder for beverage containers. The insulated holder has a subcompartment which contains a refrigerant material to impart a cooling effect to the beverage container via conductive heat transfer.

U.S. Pat. No. 4,485,636 issued Dec. 4, 1984 to Rolando V. Hilado described a container with cooling capability. The container has an inner wall and an outer wall which define and annular cavity. The annular cavity is filled with a nontoxic refrigerant solution which, when frozen, delivers a chilling effect to a beverage contained within the container.

U.S. Pat. No. 4,577,474 issued Mar. 25, 1986 to Walter E. Peterson describes a thermally insulated holder for a single beverage can which includes a hollow cylindrical jacket for receiving a beverage can therein. The hollow jacket has a refrigerant container disposed at each end juxtaposed both the top and the bottom surface of the beverage can.

U.S. Pat. No. 4,745,776 issued May 24, 1988 to Wilbert P. Clark discloses a single can cooler including a container having a bottom assembly. A refrigerant element is insertable into a hollow portion of the bottom assembly and has a raised top surface for the reception of a beverage can.

U.S. Pat. No. 4,989,415 issued Feb. 5, 1991 to Jeffrey G. Lombness described a cooling holder for a beverage container having a base which contains a refrigerant solution. The base has an outside diameter which conforms to the inside diameter of the holder and has a flexible top surface to ensure continuous contact with the bottom surface of the beverage container.

None of the above inventions and patents, taken either singly or in combination, is seen to describe the instant invention as claimed.

SUMMARY OF THE INVENTION

The present invention is related to a refrigerant puck insertable into a hollow insulated beverage container holder and is positioned juxtaposed a bottom inside surface thereof. A portable beverage-filled container is insertable concentrically into the insulated beverage container holder above the refrigerant puck such that a bottom surface of the beverage-filled container contacts a top surface of the refrigerant puck to permit conductive heat transfer to occur, thus keeping the beverage-filled container cool for an extended period of time while facilitating the consumption of a beverage of a beverage therefrom.

The refrigerant puck includes a disk-shaped container preferably formed from a high-density polyurethane or polyethylene. The disk-shaped container has a cylindrical sidewall which has an outside diameter that corresponds to an inside diameter of the insulated beverage container holder. The disk-shaped container also has a raised top surface which has a periphery that is smaller in diameter then that of the sidewall. The raised top surface is substantially convex to mate with a concave bottom surface of the beverage-filled container. This mating ensures that the raised top surface of the disk-shaped container maintains a continuous and uniform contact with the majority of the bottom surface of the beverage-filled container, thus providing a direct cooling effect. The disk-shaped container further has a substantially concave bottom surface which mates with the convex top surface thereof. This enables a plurality disk-shaped containers to be stackably nested on one another. The convex top surface and the concave bottom surface of the disk-shaped container each have a slight flat uppermost surface. This uppermost surface is provided to display an advertisement or a logo. This flat surface does not interfere with the ability of a plurality of refrigerant pucks to be stackably nested together.

The disk-shaped container is filled with a non-toxic liquid refrigerant solution which imparts the aforementioned cooling effect on the beverage-filled container. The refrigerant solution may be composed of aqueous methyl cellulose, glycerines, and glycol-type compositions. The refrigerant solution is freezable by storing the refrigerant puck in a freezer compartment. After the refrigerant solution is frozen, the refrigerant puck is subsequently used simply by being inserted into a suitable insulated beverage container holder and inserting a beverage-filled container in the same.

An object of the present invention is to provide a refrigerant puck which is usable in preexisting insulated beverage container holders.

Another object of the present invention is to provide a refrigerant puck which retards the warming of a beverage in a portable beverage-filled container by cooling, or heat transfer by conduction.

Yet another object of the present invention is to provide a refrigerant puck which has a raised top surface which is configured to conformed to the bottom surface of a beverage-filled container.

Further, an object of the present invention is to provide a refrigerant puck which has a substantially convex top surface which mates with a substantially concave bottom surface to permit a plurality of the same to be stackably nested on one another to provide a conservation of space.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS(S)

Figure 1:
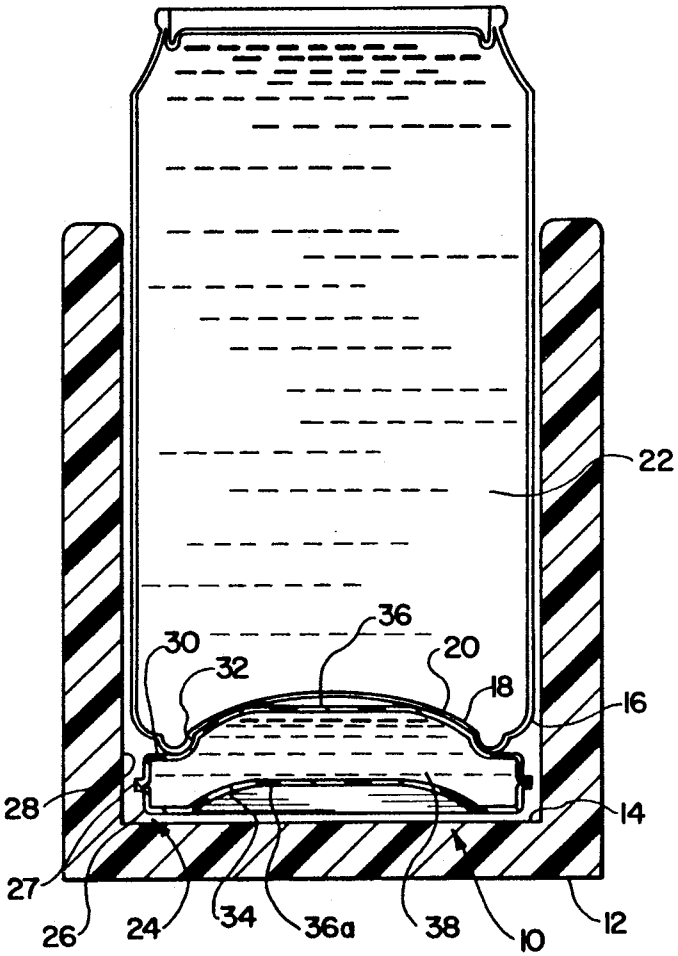
FIG. 1 is an environmental cross-sectional view of the refrigerant puck.

Now referring to the drawings, FIG. 1 shows a refrigerant puck 10 insertable concentrically into a hollow insulated beverage container holder 12. The refrigerant puck 10 is positioned juxtaposed a bottom inside surface 14 of the insulated beverage container holder 12. A beverage-filled container 14 is insertable concentrically into the insulated beverage container holder 14 above the refrigerant puck 10 such that a bottom surface 18 of the beverage-filled container 16 contacts a top surface 20 of the refrigerant puck 10 to keep the beverage-filled container 16 cool for an extended period of time while facilitating the consumption of a beverage 22 therefrom.

Figure 4:
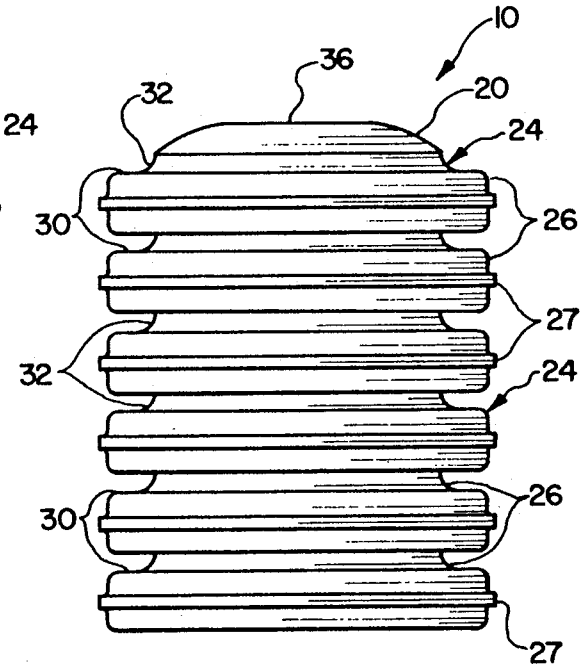
FIG. 4 is an environmental side elevational of a plurality of refrigerant pucks nested together in a stack.
Figure 2:
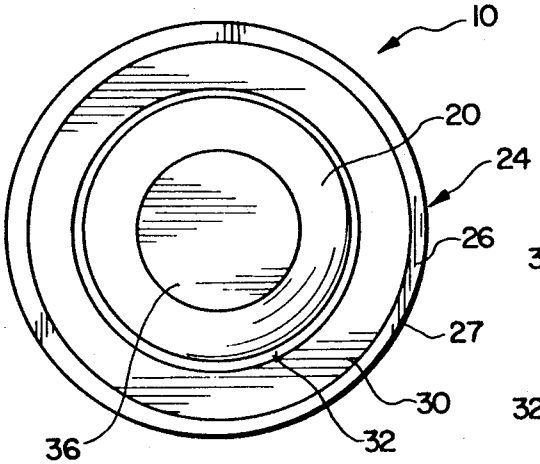
FIG. 2 is a top plan view of the refrigerant puck as shown in FIG. 1.
Figure 3:
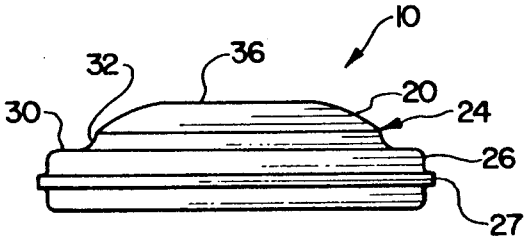
FIG. 3 is a side elevational of the refrigerant puck as shown in FIG. 2.

Now referring to FIGS. 1-3, the refrigerant puck 10 included a disk-shaped container 24 preferably formed of a high-density polyurethane or polyethylene. The disk-shaped container 24 has a cylindrical sidewall 26 having an outside diameter of 2.438 inches with a flange 27 protruding therefrom providing the disk-shaped container 24 with an overall diameter of 2.563 inches, which is slightly smaller than the inside diameter 28 of the insulated beverage container holder 12. The top surface 20 protrudes from a shoulder 30. The top surface 20 is 0.300 of an inch high and has an overall periphery 32 which has a diameter of 1.828 inches, which is noticeably smaller in diameter than the diameter of the sidewall 26. The top surface 20 is substantially convex in shape to mate with a concave bottom surface 18 of the beverage-filled container 16. The convex shape of the disk-shaped container 24 ensures that the top surface 20 maintains substantially continuous and uniform contact with the majority of the bottom surface 18 of the beverage-filled container 16, thus providing a direct cooling effect, or a conductive heat transfer. The disk-shaped container 24 further has an essentially concave bottom surface 34 which is 0.063 of an inch in depth and has a configuration which mates with the convex top surface 20 thereof. This enables a plurality of refrigerant pucks 10 to be stackably nested on one another as shown in FIG. 4. The convex top surface 20 and the concave bottom surface 34 of the disk-shaped container 24 each have a slightly flat uppermost surface **36,36*a* which has a radius of 0.996 of an inch. These uppermost surfaces 36,36*a* are provided to display indicia such as an advertisement or a logo (not shown). These uppermost surfaces 36,36*a* do not interfere with the ability of a plurality of refrigerant pucks 10** to be stackably nested together.

Referring to FIG. 1, the disk-shaped container 24 has an internal volume of 1.830 cubic inches which is filled near capacity with a non-toxic liquid refrigerant solution 38. This refrigerant solution imparts the aforementioned cooling effect on the beverage-filled container 16 by conductive heat transfer. The refrigerant solution 38 may be composed of the aqueous methyl cellulose, glycerines, and glycol-type compositions. The refrigerant solution 38 is freezable by storing the refrigerant puck 10 in a freezer compartment (not shown). After the refrigerant solution 38 is frozen, the refrigerant puck 10 is subsequently used simply by being inserted concentrically into a suitable insulated beverage container holder 16 and then inserting a beverage-filled container 16 in the same.

It is to be understood that the present invention is not limited to the sole embodiment described above, but encompasses any and all embodiments within the scope of the following claims.

I claim:

1. A refrigerant device which is removably insertable into an insulated beverage container holder for keeping a beverage container cool for an extended period while facilitating a consumption of a beverage therefrom, the beverage container being generally cylindrical in shape and having a predetermined outside diameter and a concave bottom surface, said refrigerant device comprising:

a) a disk-shaped container which includes a raised top surface that substantially conforms to and essentially maintains contact with the bottom surface of the beverage container, said disk-shaped container having a cylindrical sidewall with a peripheral flange radially extending therefrom, said flange having an outside diameter which corresponds to slightly smaller than an inside diameter of the holder, said disk-shaped container further having a bottom surface which is substantially concave and which has a configuration that conforms to said top surface to enable a plurality of said disk-shaped containers to be nestingly stackable; and b) a non-toxic refrigerant substance in said disk-shaped container to impart a cooling effect on the beverage container by conductive heat transfer through the bottom surface of the beverage container, whereby said refrigerant device is stored in a freezer compartment until frozen, said refrigerant device then being removed from the freezer compartment in a frozen state and deposited into an insulated beverage container holder with said raised top surface projecting upwards, the beverage container then being placed concentrically within the insulated beverage container holder such that the bottom surface of the beverage container contacts said top surface of said refrigerant device enabling conductive heat transfer to occur said raised top surface having a periphery which has a diameter which is smaller than a diameter of the side wall.

2. The device according to claim 1, wherein an uppermost surface of said raised top surface and said concave bottom surface are slightly flat to support indicia thereon.

* * * * *